US009961456B2

(12) United States Patent
Dittberner

(10) Patent No.: US 9,961,456 B2
(45) Date of Patent: May 1, 2018

(54) OMNI-DIRECTIONAL PERCEPTION IN A BINAURAL HEARING AID SYSTEM

(71) Applicant: GN Hearing A/S, Ballerup (DK)

(72) Inventor: Andrew Burke Dittberner, Antioch, IL (US)

(73) Assignee: GN Hearing A/S, Ballerup (DK)

( * ) Notice: Subject to any disclaimer, the term of this patent is extended or adjusted under 35 U.S.C. 154(b) by 0 days. days.

(21) Appl. No.: 14/312,463

(22) Filed: Jun. 23, 2014

(65) Prior Publication Data

US 2015/0373464 A1 Dec. 24, 2015

(51) Int. Cl.
*H04R 25/00* (2006.01)
*H04R 1/10* (2006.01)

(52) U.S. Cl.
CPC ..... *H04R 25/40* (2013.01); *H04R 1/10* (2013.01); *H04R 25/407* (2013.01); *H04R 25/552* (2013.01); *H04R 2225/43* (2013.01)

(58) Field of Classification Search
CPC .... H04R 25/40; H04R 25/402; H04R 25/405; H04R 25/407
USPC ..... 381/313
See application file for complete search history.

(56) References Cited

U.S. PATENT DOCUMENTS 7,366,312 B2 * 4/2008 Sugimoto ..... H04S 5/00 381/1
7,916,882 B2 * 3/2011 Pedersen ..... H04R 25/505 381/313
2002/0041695 A1 4/2002 Luo
2003/0156725 A1 8/2003 Boone et al.
2009/0175466 A1 * 7/2009 Elko ..... H04R 3/005 381/94.2
2010/0027809 A1 * 2/2010 Liu ..... H04R 3/005 381/92
2010/0329492 A1 * 12/2010 Derleth ..... G10L 21/0208 381/317

(Continued)

FOREIGN PATENT DOCUMENTS

JP 2011139462 A 7/2011
WO WO 2009/072040 A1 6/2009

OTHER PUBLICATIONS

First technical examination and Search Repot dated Apr. 16, 2015, for corresponding Danish Patent Application No. PA 2014 70407, 4 pages.

(Continued)

*Primary Examiner* — Sean H Nguyen
(74) *Attorney, Agent, or Firm* — Vista IP Law Group, LLP

(57) ABSTRACT

A hearing aid system includes: a first hearing aid comprising a first set of microphones, a first beamformer, a first processing module, and a first receiver; and a second hearing aid comprising a second set of microphones, a second beamformer, a second processing module, and a second receiver; wherein the first beamformer in a first operating mode is configured to provide a first audio signal in accordance with a first primary spatial characteristic, wherein the second beamformer in the first operating mode is configured to provide a second audio signal in accordance with a second primary spatial characteristic, the first primary spatial characteristic having a first main lobe with a first direction, and the second primary spatial characteristic having a second main lobe with a second direction, wherein the second direction is different from the first direction.

28 Claims, 5 Drawing Sheets

(56) References Cited

U.S. PATENT DOCUMENTS

| | | | | |
|---|---|---|---|---|
| 2011/0116666 | A1* | 5/2011 | Dittberner | H04R 25/50 381/313 |
| 2012/0008807 | A1* | 1/2012 | Gran | H04R 25/407 381/313 |
| 2012/0019689 | A1* | 1/2012 | Zurek | H04R 3/005 348/240.99 |
| 2013/0258813 | A1* | 10/2013 | Herre | H04R 1/406 367/135 |
| 2013/0287237 | A1 | 10/2013 | Aubreville et al. | |
| 2013/0329923 | A1 | 12/2013 | Bouse | |
| 2013/0336507 | A1 | 12/2013 | Gran | |
| 2014/0086417 | A1* | 3/2014 | Hansen | H04R 25/43 381/23.1 |

OTHER PUBLICATIONS

Extended European Search Report dated Jul. 20, 2015 for corresponding European Patent Application No. 14175195.8, 7 pages.
Japanese Office Action dated Dec. 14, 2017 for corresponding JP Application No. JP 2015 112 418. 4 pages.
English Translation for Japanese Office Action dated Dec. 14, 2017 for corresponding JP Application No. JP 2015 112 418. 4 pages.

* cited by examiner

OMNI-DIRECTIONAL PERCEPTION IN A BINAURAL HEARING AID SYSTEM

FIELD

The present disclosure relates to method and apparatus for provision of beamforming in hearing aids, and in particular for beamforming in a binaural hearing aid system.

BACKGROUND

One of the most important tasks for modern hearing aids is to provide improvement in speech intelligibility in the presence of noise. For this purpose, beamforming, especially adaptive beamforming, has been widely used in order to suppress interfering noise. Traditionally, the user of a hearing aid is given the possibility of changing between a directional and an omni-directional mode in the hearing aid (e.g. the user simply changes processing modes by flipping a toggle switch or pushing a button on the hearing aid to put the device in the preferred mode according to the listening conditions encountered in a specific environment). Recently, even automatic switching procedures for switching between directional and omni-directional modes have been employed in hearing aids.

In hearing aids, omni-directional perception by the user may be preferred over a directional mode for relatively quiet listening situations due to the fact that in situations, where any background noise present is fairly low in amplitude, the omni-directional mode should provide a greater access to the full range of sounds in the surrounding environment, which is intended to provide a greater feeling of "connectedness" to the environment, i.e. being connected to the outside world. The general preference for omni-directional processing when the signal source is to the side or behind the listener is predictable. Further, by providing greater access to sound sources that the listener is not currently facing, omni-directional perception may improve recognition for speech signals arriving from these locations (e.g., in a restaurant where the server speaks from behind or from the side of the listener). This benefit of omni-directional perception for target signals arriving from locations other than in front of the listener will be present in both quiet and noisy listening situations.

Binaural beamforming is known in the art. Currently, most beamformers are designed to process the multiple signals from the two hearing aids to achieve the best possible Signal-Noise-Ratio.

SUMMARY

There is a need for an improved omni-directional perception for a hearing aid user.

Disclosed is a hearing aid system comprising a first hearing aid and a second hearing aid. The first hearing aid comprises a first set of microphones for provision of one or more electrical first input signals; a first beamformer connected to the first set of microphones for provision of a first audio signal; a first processing module for provision of a first output signal; and a first receiver for provision of a first audio output. The second hearing aid comprises a second set of microphones for provision of one or more electrical second input signals; a second beamformer connected to the second set of microphones for provision of a second audio signal; a second processing module for provision of a second output signal; and a second receiver for provision of a second audio output. The first beamformer is in a first operating mode of the hearing aid system configured to provide the first audio signal in accordance with a first primary spatial characteristic, and the second beamformer is the first operating mode of the hearing aid system configured to provide the second audio signal in accordance with a second primary spatial characteristic, the first primary spatial characteristic having a first main lobe with a first direction and the second primary spatial characteristic having a second main lobe with a second direction. The second direction may be different from the first direction.

Also disclosed is a method for providing audio signals in a hearing aid system comprising a first hearing aid and a second hearing aid. The method comprises providing a first audio signal in accordance with a first primary spatial characteristic in a first operating mode of the hearing aid system; providing a second audio signal in accordance with a second primary spatial characteristic in the first operating mode of the hearing aid system; providing a first output signal based on the first audio signal; providing a second output signal based on the second audio signal; providing a first audio output based on the first output signal; and providing a second audio output based on the second output signal. The first primary spatial characteristic has a first main lobe with a first direction and the second primary spatial characteristic has a second main lobe with a second direction, wherein the second direction may be different from the first direction.

It is an advantage of one or more embodiments described herein that an improved omni-directional perception is provided. The present disclosure relies on the auditory system of the user.

Further, one or more embodiments described herein provide improved omni-directional perception using directional spatial characteristics, thereby simplifying processing in an omni-directional operating mode of the hearing aid system.

A hearing aid system includes: a first hearing aid comprising: a first set of microphones for provision of one or more electrical first input signals, a first beamformer connected to the first set of microphones for provision of a first audio signal, a first processing module for provision of a first output signal, and a first receiver for provision of a first audio output; and a second hearing aid comprising: a second set of microphones for provision of one or more electrical second input signals, a second beamformer connected to the second set of microphones for provision of a second audio signal, a second processing module for provision of a second output signal, and a second receiver for provision of a second audio output; wherein the first beamformer in a first operating mode of the hearing aid system is configured to provide the first audio signal in accordance with a first primary spatial characteristic, wherein the second beamformer in the first operating mode of the hearing aid system is configured to provide the second audio signal in accordance with a second primary spatial characteristic, the first primary spatial characteristic having a first main lobe with a first direction, and the second primary spatial characteristic having a second main lobe with a second direction, wherein the second direction is different from the first direction.

Optionally, the hearing aid system further includes a first mode controller connected to the first beamformer for controlling the first beamformer.

Optionally, the first mode controller is connected to the second beamformer for controlling the second beamformer.

Optionally, the hearing aid system further includes a second mode controller connected to the second beamformer for controlling the second beamformer.

Optionally, a difference between a gain of the first primary spatial characteristic in the first direction and a gain of the second primary spatial characteristic in the first direction is larger than 3 dB.

Optionally, a difference between a gain of the second primary spatial characteristic in the second direction and a gain of the first primary spatial characteristic in the second direction is larger than 3 dB.

Optionally, the first beamformer is connected to one or more microphones of the second set of microphones for provision of the first audio signal based on the one or more electrical second input signals.

Optionally, the second beamformer is connected to one or more microphones of the first set of microphones for provision of the second audio signal based on the one or more electrical first input signals.

Optionally, an angle between the first direction and the second direction is anywhere from 160 degrees to 200 degrees.

Optionally, the first direction is within ±20 degrees of a 0-direction.

Optionally, the second direction is within ±60 degrees of a 180-direction.

A method for providing audio signals in a hearing aid system comprising a first hearing aid and a second hearing aid, includes: providing a first audio signal in accordance with a first primary spatial characteristic in a first operating mode of the hearing aid system; providing a second audio signal in accordance with a second primary spatial characteristic in the first operating mode of the hearing aid system; providing a first output signal based on the first audio signal; providing a second output signal based on the second audio signal; providing a first audio output based on the first output signal; and providing a second audio output based on the second output signal; wherein the first primary spatial characteristic has a first main lobe with a first direction, and the second primary spatial characteristic has a second main lobe with a second direction, wherein the second direction is different from the first direction.

Other and further aspects and features will be evident from reading the following detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
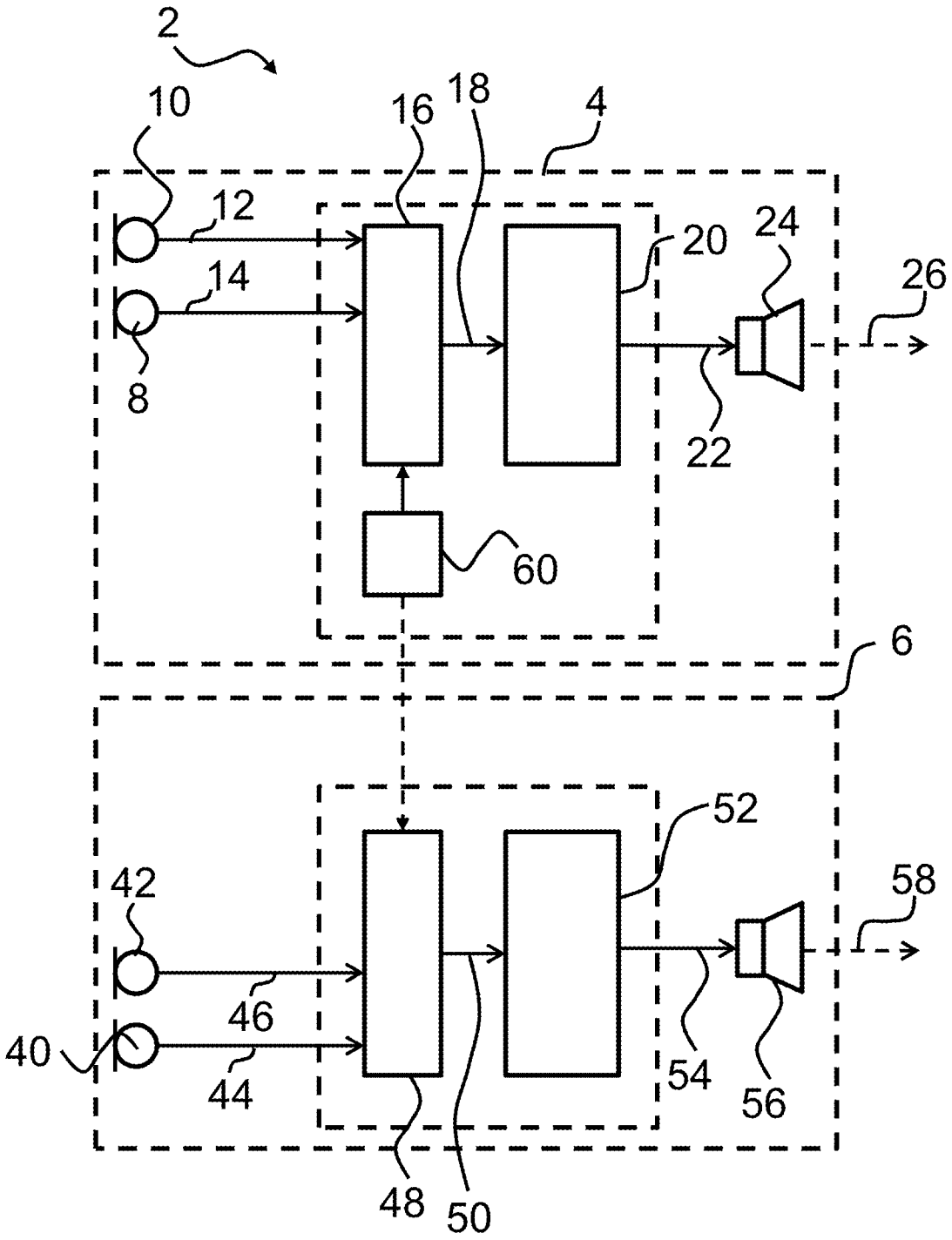
FIG. 1 schematically illustrates an exemplary hearing aid system.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

A hearing aid system comprising a first hearing aid and a second hearing aid is disclosed herein.

The first hearing aid comprises a first set of microphones for provision of one or more electrical first input signals. The first set of microphones may comprise one, two, three, four or more first microphones, such as a first primary microphone, optionally a first secondary microphone, and optionally a first tertiary microphone. The first hearing aid comprises a first beamformer connected to the set of first microphones or at least a subset thereof for provision of a first audio signal, e.g. based on one or more electrical first input signals from the first set of microphones. The first audio signal may be based on a first primary input signal from the first primary microphone and/or a first secondary input signal from the first secondary microphone.

The first hearing aid comprises a first processing module for provision of a first output signal, e.g. based on the first audio signal from the first beamformer. The first hearing aid comprises a first receiver or a first receiver module for provision of a first audio output, e.g. by converting the first output signal to the first audio output.

The second hearing aid comprises a second set of microphones for provision of one or more electrical second input signals. The second set of microphones may comprise one, two, three, four or more second microphones, such as a second primary microphone, optionally a second secondary microphone, and optionally a second tertiary microphone. The second hearing aid comprises a second beamformer connected to the second set of microphones or at least a subset thereof for provision of a second audio signal, e.g. based on one or more electrical second input signals from the second set of microphones. The second audio signal may be based on a second primary input signal from the second primary microphone and/or a second secondary input signal from the second secondary microphone.

The second hearing aid comprises a second processing module for provision of a second output signal, e.g. based on the second audio signal from the second beamformer. The second hearing aid comprises a second receiver or second receiver module for provision of a second audio output, e.g. by converting the second output signal to the second audio output.

The hearing aid system may be configured to operate in one or more operating modes, e.g. including a first operating mode. An operating mode sets or defines operating parameters or control parameters of different elements or parts of the hearing aid system. The hearing aid system may comprise one or more mode controllers for controlling and/or determining operating parameters or control parameters for elements or parts of the hearing aid system.

A spatial characteristic defines the gain and/or phase applied to a signal in dependence of the direction and optionally the frequency of the signal. The 0-direction of a spatial characteristic is in the present context defined as the viewing or forward direction for a user of the hearing aid system. A main lobe of a spatial characteristic is the region around the direction of maximum gain. The direction of maximum gain is also noted as the direction of the main lobe.

The beamformers are configured to provide an electrical audio signal in accordance with a spatial characteristic, e.g. based on electrical input signals from microphones. In other words the beamformers are configured to combine electrical input signals to provide the first audio signal in accordance with a spatial characteristic.

The first beamformer may in a first operating mode of the hearing aid system be configured to provide the first audio signal in accordance with a first primary spatial characteristic. The second beamformer may in the first operating mode of the hearing aid system be configured to provide the second audio signal in accordance with a second primary spatial characteristic.

Accordingly, the first primary spatial characteristic has a first main lobe with a first direction and the second primary spatial characteristic has a second main lobe with a second direction.

The second direction is different from the first direction. The angle between the first direction and the second direction may be larger than 60 degrees. The angle between the first direction and the second direction may be in the range from 160 degrees to 200 degrees, e.g. in order to provide substantially opposite first primary and second primary spatial characteristics.

The first direction may be a forward direction, e.g. within ±45 degrees of the 0-direction. In an exemplary hearing system, the first direction is within ±20 degrees of the 0-direction.

The second direction may be a backward direction, e.g. within ±60 degrees of the 180-direction, such as within ±45 degrees of the 180-direction. In an exemplary hearing system, the second direction is within ±20 degrees of the 180-direction.

The hearing aid system, e.g. the first hearing aid, may comprise a first mode controller connected to the first beamformer for controlling operating modes of the first beamformer. The first mode controller may be connected to the second beamformer for controlling operating modes of the second beamformer. The connection between the first mode controller and the second beamformer may be wireless or wired.

The hearing aid system may comprise a second mode controller connected to the second beamformer for controlling operating modes of the second beamformer. The first mode controller may be connected to the second mode controller.

The first spatial characteristic applied by the first beamformer in an operating mode of the hearing aid system may have less gain in the second direction of the second spatial characteristic in the operating mode compared to the gain of the second primary spatial characteristic in the second direction.

The second spatial characteristic applied by the second beamformer in an operating mode of the hearing aid system may have less gain in the first direction of the first spatial characteristic in the operating mode compared to the gain of the first primary spatial characteristic in the first direction.

For example, the difference between the gain of the first primary spatial characteristic in the first direction and the gain of the second primary spatial characteristic in the first direction may be larger than a first threshold value, such as larger than 3 dB.

The difference between the gain of the second primary spatial characteristic in the second direction and the gain of the first primary spatial characteristic in the second direction may be larger a second threshold value, such as larger than 3 dB.

The first beamformer may be connected to one or more microphones of the second set of microphones for provision of the first audio signal based on one or more electrical second input signals. The connection may be a wireless connection.

The second beamformer may be connected to one or more microphones of the first set of microphones for provision of the second audio signal based on one or more electrical first input signals. The connection may be a wireless connection.

FIG. 1 schematically illustrates an exemplary hearing aid system. The hearing aid system 2 comprises a first hearing aid 4 and a second hearing aid 6. The first hearing aid 4 comprises a first set of microphones 8, 10 for provision of one or more electrical first input signals 12, 14; a first beamformer 16 connected to the first set of microphones 12, 14 for provision of a first audio signal 18; a first processing module 20 for provision of a first output signal 22; and a first receiver 24 for provision of a first audio output 26. The second hearing aid 6 comprises a second set of microphones 40, 42 for provision of one or more electrical second input signals 44, 46; a second beamformer 48 connected to the second set of microphones 40, 42 for provision of a second audio signal 50; a second processing module 52 for provision of a second output signal; and a second receiver 56 for provision of a second audio output 58.

In a first operating mode of the hearing aid system, the first beamformer 16 is configured to provide the first audio signal 18 in accordance with a first primary spatial characteristic, and the second beamformer 48 is configured to provide the second audio signal 50 in accordance with a second primary spatial characteristic. The first primary spatial characteristic has a first main lobe with a first direction and the second primary spatial characteristic has a second main lobe with a second direction, wherein the second direction is different from the first direction.

The hearing aid system 2 optionally comprises a first mode controller 60 connected to the first beamformer 16 and/or the second beamformer 48. The first mode controller 60 is arranged in the first hearing aid 4 and controls operating mode of the first beamformer 16 and/or the second beamformer 48. An operating mode of a beamformer defines the spatial characteristic to be applied by the beamformer.

Figure 2:
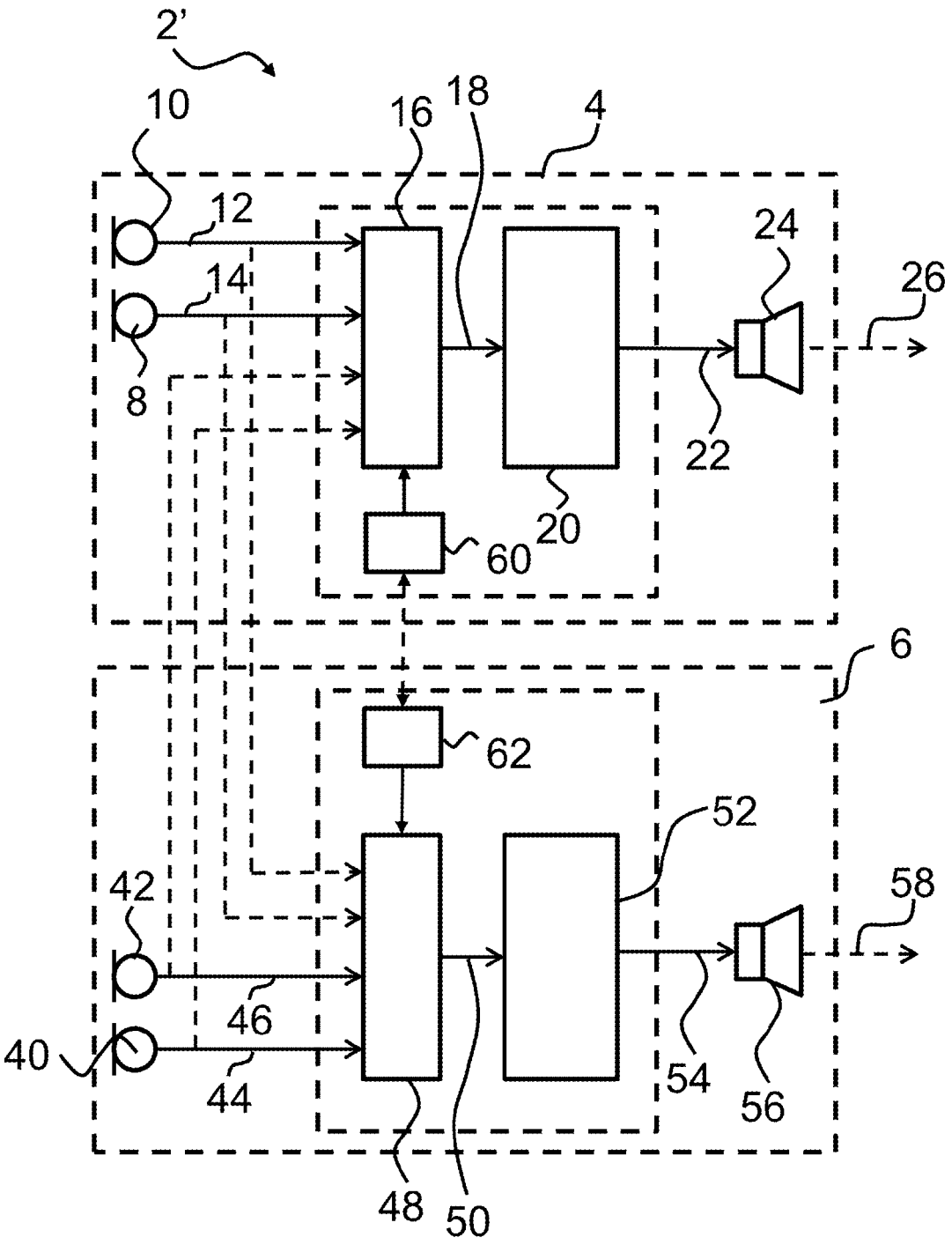
FIG. 2 schematically illustrates an exemplary hearing aid system.

FIG. 2 schematically illustrates an exemplary hearing aid system. The hearing aid system 2' optionally comprises a second mode controller 62 connected to the second beamformer 48 for controlling operating mode of the second beamformer. The second mode controller 62 is arranged in the second hearing aid 6 and is configured to communicate, e.g. wirelessly, with the first mode controller 60. Further, the first beamformer 16 is wirelessly connected to one or more microphones 40, 42 of the second set of microphones for provision of the first audio signal based on one or more of the electrical second input signals 44, 46 or representations thereof. Optionally, the second beamformer 48 is wired or wirelessly connected to one or more microphones 8, 10 of the first set of microphones for provision of the second audio signal based on one or more of the electrical first input signals 12, 14 or representations thereof. A beamformer connected to microphones of different hearing aids may allow for higher design freedom of the spatial characteristics applied in the beamformer.

Figure 3:
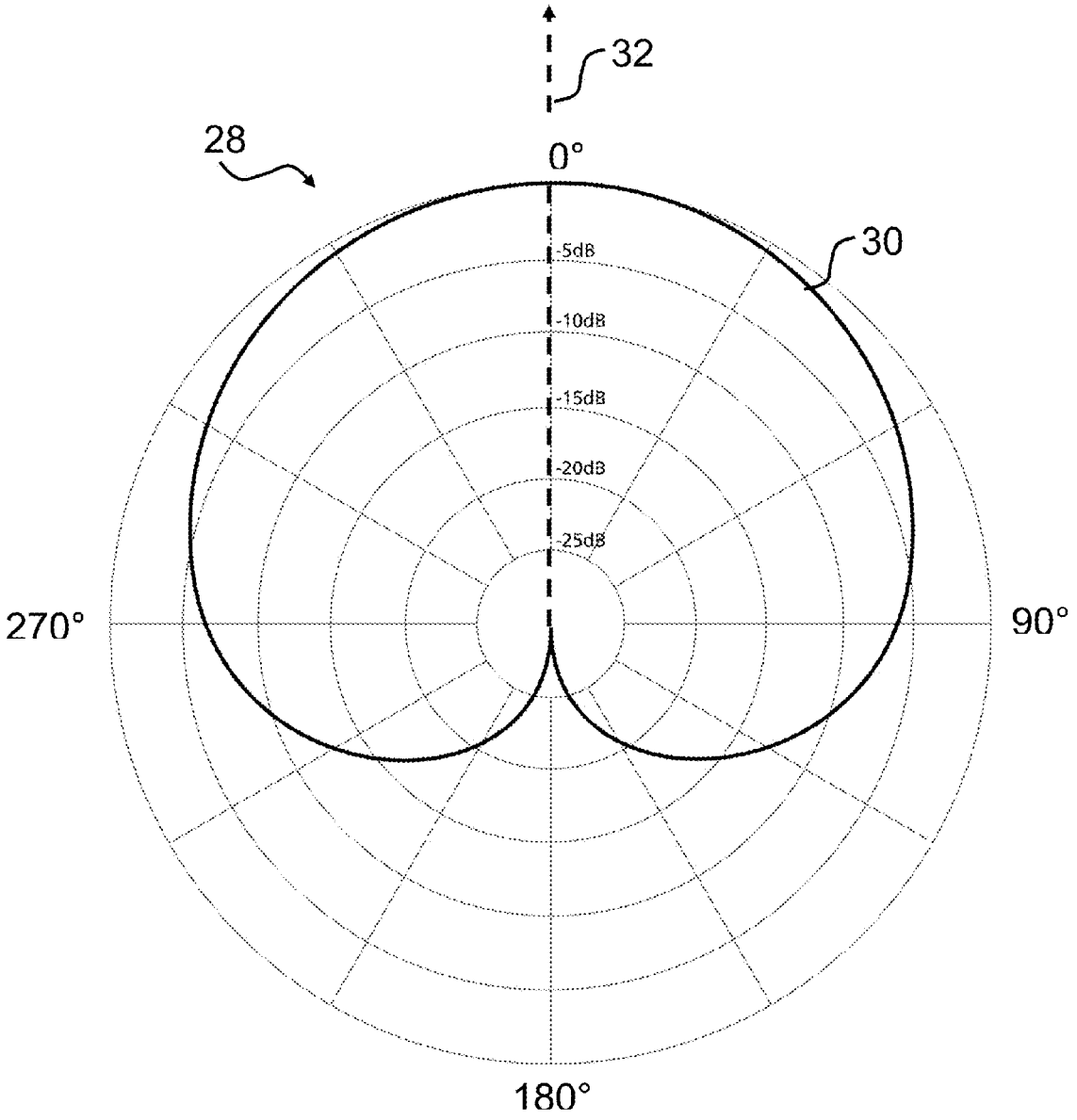
FIG. 3 schematically illustrates an exemplary spatial characteristic.
Figure 4:
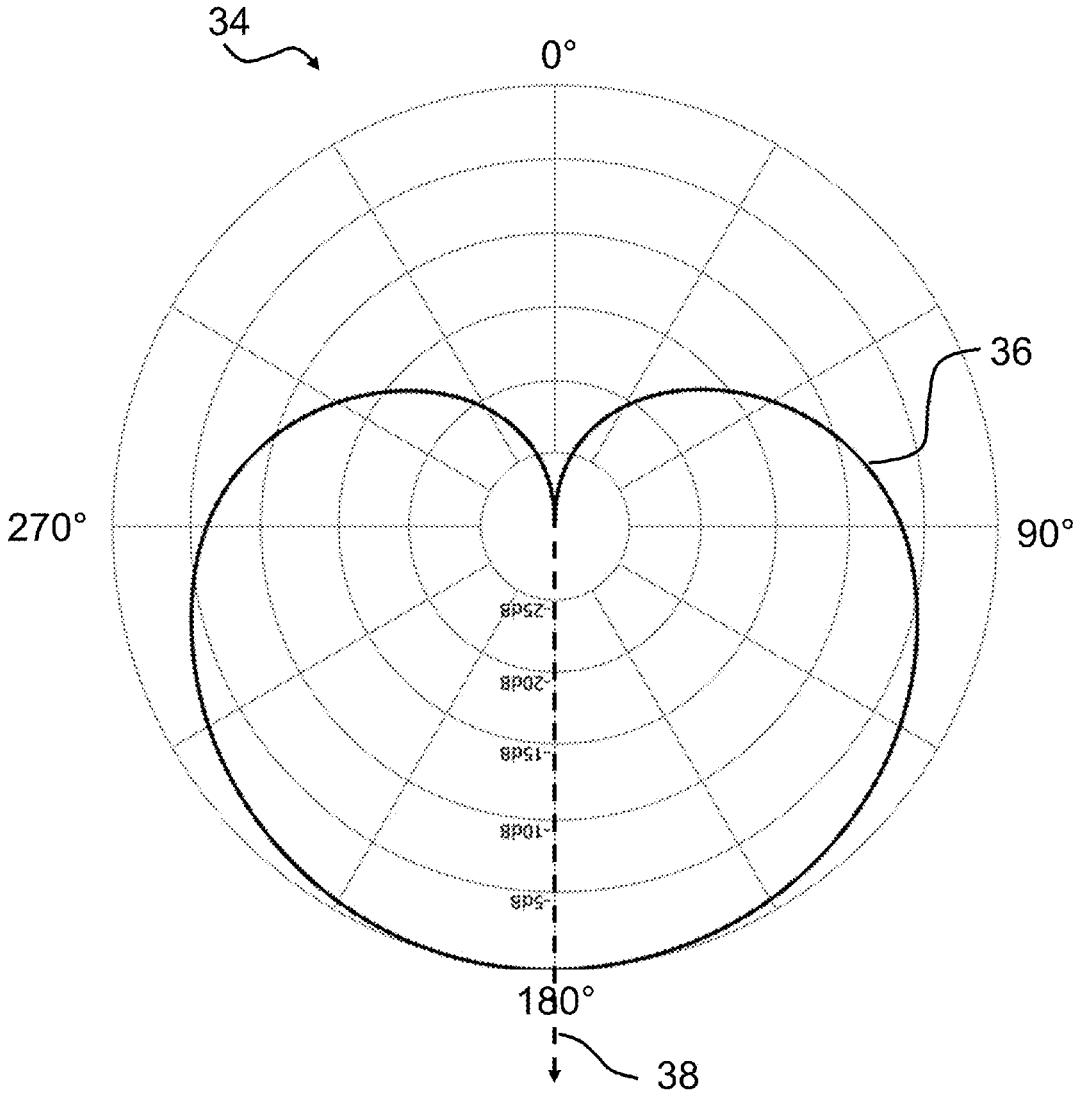
FIG. 4 schematically illustrates an exemplary spatial characteristic.

FIG. 3 and FIG. 4 illustrate exemplary spatial characteristics applied by respective first and second beamformers in a first operating mode of the hearing aid system. FIG. 3 illustrates an exemplary first primary spatial characteristic 28 applied by the first beamformer, the first primary spatial characteristic 28 having a first main lobe 30 with a first direction (dotted arrow) 32 in the 0-direction. FIG. 4 illustrates an exemplary second primary spatial characteristic 34 applied by a second beamformer, the second primary spatial characteristic 34 having a second main lobe 36 with a second direction (dotted arrow) 38 in the 180-direction. The first direction 32 and the second direction 38 are opposite, i.e. having an angle of 180 degrees.

The difference between the gain $G_{1,0}$ of the first primary spatial characteristic 28 in the first direction and the gain $G_{2,0}$ of the second primary spatial characteristic in the first direction is larger than a first threshold value of 3 dB.

The difference between the gain $G_{2,180}$ of the second primary spatial characteristic in the second direction and the gain $G_{1,180}$ of the first primary spatial characteristic in the second direction (here corresponding to the 180-direction) is larger a second threshold value of 3 dB.

Figure 5:
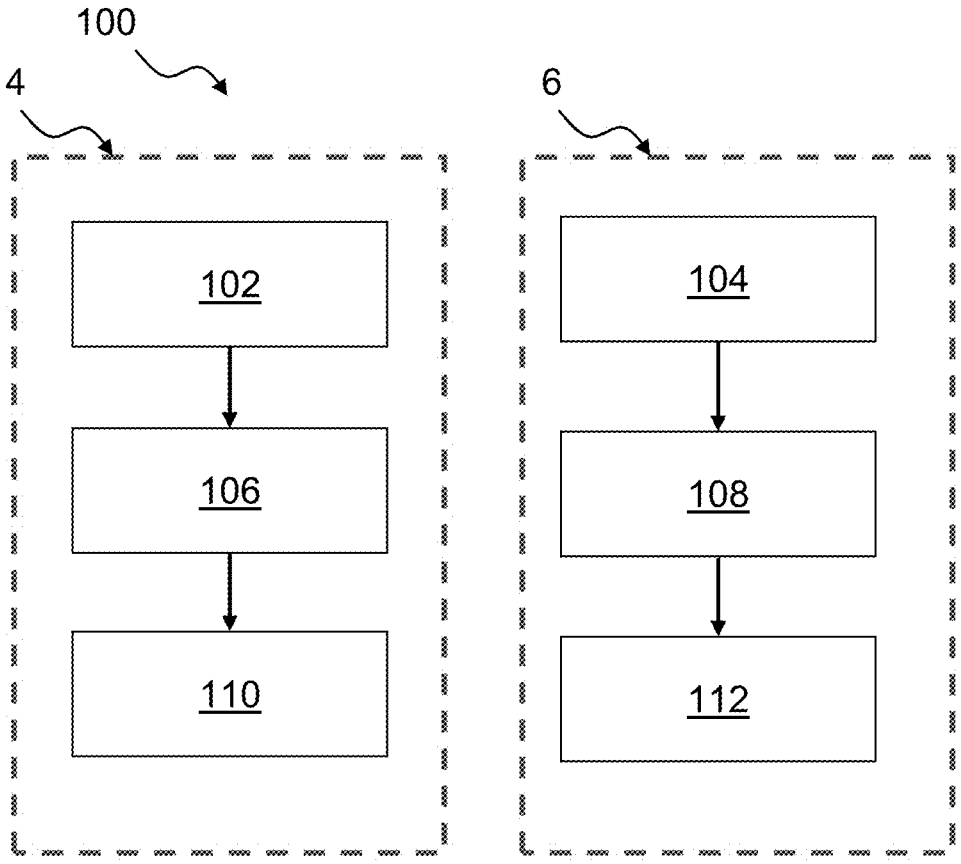
FIG. 5 is a flow diagram of an exemplary method.

FIG. 5 is a flow diagram of an exemplary method for providing audio signals in a hearing aid system comprising a first hearing aid and a second hearing aid. The method 100 comprises providing 102, e.g. with a first beamformer 16, a first audio signal in accordance with a first primary spatial characteristic in a first operating mode of the hearing aid system, and providing 104, e.g. with a second beamformer 48, a second audio signal in accordance with a second primary spatial characteristic in the first operating mode of the hearing aid system. Further, the method comprises providing 106 a first output signal based on the first audio signal. Providing a first output signal may comprise compensating for a hearing loss of a user. The method comprises providing 108 a second output signal based on the second audio signal. Providing a second output signal may comprise compensating for a hearing loss of a user. The method comprises providing 110 a first audio output based on the first output signal and providing 112 a second audio output based on the second output signal. The first primary spatial characteristic has a first main lobe with a first direction and the second primary spatial characteristic has a second main lobe with a second direction, wherein the second direction is different from the first direction.

The following items are in accordance with one or more embodiments described herein:

Item 1. A hearing aid system comprising: (1) a first hearing aid comprising: a first set of microphones for provision of one or more electrical first input signals, a first beamformer connected to the first set of microphones for provision of a first audio signal, a first processing module for provision of a first output signal, and a first receiver for provision of a first audio output; and (2) a second hearing aid comprising: a second set of microphones for provision of one or more electrical second input signals, a second beamformer connected to the second set of microphones for provision of a second audio signal, a second processing module for provision of a second output signal, and a second receiver for provision of a second audio output; wherein the first beamformer in a first operating mode of the hearing aid system is configured to provide the first audio signal in accordance with a first primary spatial characteristic, wherein the second beamformer in the first operating mode of the hearing aid system is configured to provide the second audio signal in accordance with a second primary spatial characteristic, the first primary spatial characteristic having a first main lobe with a first direction and the second primary spatial characteristic having a second main lobe with a second direction, wherein the second direction is different from the first direction.

Item 2. Hearing aid system according to item 1, wherein the hearing aid system comprises a first mode controller connected to the first beamformer for controlling the first beamformer.

Item 3. Hearing aid system according to item 2, wherein the first mode controller is connected to the second beamformer for controlling the second beamformer.

Item 4. Hearing aid system according to any of items 1-2, wherein the hearing aid system comprises a second mode controller connected to the second beamformer for controlling the second beamformer.

Item 5. Hearing aid system according to any of the preceding items, wherein a difference between a gain of the first primary spatial characteristic in the first direction and a gain of the second primary spatial characteristic in the first direction is larger than a first threshold value, such as larger than 3 dB.

Item 6. Hearing aid system according to any of the preceding items, wherein a difference between a gain of the second primary spatial characteristic in the second direction and a gain of the first primary spatial characteristic in the second direction is larger a second threshold value, such as larger than 3 dB.

Item 7. Hearing aid system according to any of the preceding items, wherein the first beamformer is connected to one or more microphones of the second set of microphones for provision of the first audio signal based on the one or more electrical second input signals.

Item 8. Hearing aid system according to any of the preceding items, wherein the second beamformer is connected to one or more microphones of the first set of microphones for provision of the second audio signal based on the one or more electrical first input signals.

Item 9. Hearing aid system according to any of the preceding items, wherein an angle between the first direction and the second direction is in the range from 160 degrees to 200 degrees.

Item 10. Hearing aid system according to any of the preceding items, wherein the first direction is within ±20 degrees of the 0-direction.

Item 11. Hearing aid system according to any of the preceding items, wherein the second direction is within ±60 degrees of the 180-direction.

Item 12. A method for providing audio signals in a hearing aid system comprising a first hearing aid and a second hearing aid, the method comprising: providing a first audio signal in accordance with a first primary spatial characteristic in a first operating mode of the hearing aid system; providing a second audio signal in accordance with a second primary spatial characteristic in the first operating mode of the hearing aid system; providing a first output signal based on the first audio signal; providing a second output signal based on the second audio signal; providing a first audio output based on the first output signal; and providing a second audio output based on the second output signal; wherein the first primary spatial characteristic has a first main lobe with a first direction and the second primary spatial characteristic has a second main lobe with a second direction, wherein the second direction is different from the first direction.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing aid system
4 first hearing aid
6 second hearing aid
8 first primary microphone
10 first secondary microphone
12 first primary input signal
14 first secondary input signal
16 first beamformer
18 first audio signal
20 first processing module
22 first output signal
24 first receiver
26 first audio output
28 first primary spatial characteristic
30 first main lobe
32 first direction
34 second primary spatial characteristic
36 second main lobe
38 second direction
40 second primary microphone
42 second secondary microphone
44 second primary input signal
46 second secondary input signal
48 second beamformer
50 second audio signal
52 second processing module
54 second output signal
56 second receiver
58 second audio output
60 first mode controller
62 second mode controller
100 method for providing audio signals in a hearing aid system
102 providing a first audio signal
104 providing a second audio signal
106 providing a first output signal
108 providing a second output signal
110 providing a first audio output
112 providing a second audio output

The invention claimed is:

1. A hearing aid system comprising:
a first hearing aid comprising:
a first set of microphones for provision of one or more first electrical input signals,
a first beamformer connected to the first set of microphones for provision of a first audio signal,
a first processing module for provision of a first output signal, and
a first receiver for provision of a first audio output; and
a second hearing aid comprising:
a second set of microphones for provision of one or more second electrical input signals,
a second beamformer connected to the second set of microphones for provision of a second audio signal,
a second processing module for provision of a second output signal, and
a second receiver for provision of a second audio output;
wherein the first beamformer in a first operating mode of the hearing aid system is configured to provide the first audio signal in accordance with a first primary spatial characteristic, wherein the second beamformer in the first operating mode of the hearing aid system is configured to provide the second audio signal in accordance with a second primary spatial characteristic, the first primary spatial characteristic having a first main lobe with a first direction associated with a forward direction, and the second primary spatial characteristic having a second main lobe with a second direction associated with a backward direction;
wherein the first primary spatial characteristic corresponds with the second primary spatial characteristic, and the second direction of the second main lobe of the second primary spatial characteristic is more than 60° from the first direction of the first main lobe of the first primary spatial characteristic;
wherein the hearing aid system further includes a first mode controller configured to control the first beamformer; and
wherein the first mode controller is configured to control both the first beamformer and the second beamformer.

2. The hearing aid system according to claim 1, further comprising a second mode controller configured to control the second beamformer.

3. The hearing aid system according to claim 1, wherein a difference between a gain of the first primary spatial characteristic in the first direction and a gain of the second primary spatial characteristic in the first direction is larger than 3 dB.

4. The hearing aid system according to claim 1, wherein a difference between a gain of the second primary spatial characteristic in the second direction and a gain of the first primary spatial characteristic in the second direction is larger than 3 dB.

5. The hearing aid system according to claim 1, wherein the first beamformer is connected to one or more microphones of the second set of microphones for provision of the first audio signal based on the one or more second electrical input signals.

6. The hearing aid system according to claim 1, wherein the second beamformer is connected to one or more microphones of the first set of microphones for provision of the second audio signal based on the one or more first electrical input signals.

7. The hearing aid system according to claim 1, wherein an angle between the first direction and the second direction is anywhere from 160 degrees to 200 degrees.

8. The hearing aid system according to claim 1, wherein the first direction is within ±20 degrees of a 0°-direction.

9. The hearing aid system according to claim 1, wherein the second direction is within ±60 degrees of a 180° direction.

10. The hearing aid system of claim 1, wherein the first beamformer in the first operating mode is configured to provide the first audio signal independent of the one or more second electrical input signals from the second set of microphones in the second hearing aid.

11. The hearing aid system of claim 1, wherein the second beamformer in the first operating mode is configured to provide the second audio signal independent of the one or more first electrical input signals from the first set of microphones in the first hearing aid.

12. The hearing aid system of claim 1, wherein the first primary spatial characteristic corresponds with the second primary spatial characteristic to provide an improved omni-directional perception for a user of the hearing aid system.

13. The hearing aid system of claim 1, wherein the forward direction is with respect to a user of the hearing aid system.

14. A method for providing audio signals in a hearing aid system comprising a first hearing aid and a second hearing aid, the method comprising:

providing a first audio signal in accordance with a first primary spatial characteristic in a first operating mode of the hearing aid system;

providing a second audio signal in accordance with a second primary spatial characteristic in the first operating mode of the hearing aid system;

providing a first output signal based on the first audio signal;

providing a second output signal based on the second audio signal;

providing a first audio output based on the first output signal; and providing a second audio output based on the second output signal;

wherein the first primary spatial characteristic has a first main lobe with a first direction associated with a forward direction, and the second primary spatial characteristic has a second main lobe with a second direction associated with a backward direction;

wherein the first primary spatial characteristic corresponds with the second primary spatial characteristic, and the second direction of the second main lobe of the second primary spatial characteristic is more than 60° from the first direction of the first main lobe of the first primary spatial characteristic;

wherein the first primary spatial characteristic is attributable to a beamformer, and wherein the method further comprises providing a mode controller to control the beamformer; and wherein the mode controller is configured to control both the beamformer, and an additional beamformer.

15. The method of claim 14, wherein the first audio signal is provided using the first hearing aid independent of a microphone output signal from the second hearing aid.

16. The method of claim 14, wherein the second audio signal is provided using the second hearing aid independent of a microphone output signal from the first hearing aid.

17. A hearing aid system comprising:

a first hearing aid comprising:

a first set of microphones for provision of one or more first electrical input signals, a first beamformer connected to the first set of microphones, a first processing module for provision of a first output signal, and a first receiver for provision of a first audio output; and a second hearing aid comprising:

a second set of microphones for provision of one or more second electrical input signals, a second beamformer connected to the second set of microphones, a second processing module for provision of a second output signal, and a second receiver for provision of a second audio output;

wherein in the first operating mode, the first beamformer of the hearing aid system and the second beamformer of the hearing aid system are configured to provide a first audio signal in accordance with a first primary spatial characteristic, and a second audio signal in accordance with a second primary spatial characteristic, the first primary spatial characteristic having a first main lobe with a first direction associated with a forward direction, and the second primary spatial characteristic having a second main lobe with a second direction associated with a backward direction;

wherein an angle between the first direction and the second direction is anywhere from 160° to 200°;

wherein the hearing aid system further includes a first mode controller configured to control the first beamformer; and wherein the first mode controller is configured to control both the first beamformer and the second beamformer.

18. The hearing aid system of claim 17, wherein the second direction is substantially opposite from the first direction.

19. The hearing aid system of claim 17, wherein the forward direction is with respect to a user of the hearing aid system.

20. A hearing aid system comprising:

a first hearing aid comprising:

a first set of microphones for provision of one or more first electrical input signals, a first beamformer connected to the first set of microphones, a first processing module for provision of a first output signal, and a first receiver for provision of a first audio output; and a second hearing aid comprising:

a second set of microphones for provision of one or more second electrical input signals, a second beamformer connected to the second set of microphones, a second processing module for provision of a second output signal, and a second receiver for provision of a second audio output;

wherein in the first operating mode, the first beamformer of the hearing aid system and the second beamformer of the hearing aid are configured to provide a first audio signal in accordance with a first primary spatial characteristic, and a second audio signal in accordance with a second primary spatial characteristic, the first primary spatial characteristic having a first main lobe with a first direction, and the second primary spatial characteristic having a second main lobe with a second direction;

wherein the first direction is anywhere from −45° to 45° with respect to a first reference direction, and wherein the second direction is anywhere from −60° to 60° with respect to a second reference direction that is opposite the first reference direction, and wherein the first reference direction is a forward direction;

wherein the hearing aid system further includes a first mode controller configured to control the first beamformer; and wherein the first mode controller is configured to control both the first beamformer and the second beamformer.

21. The hearing aid system of claim 20, wherein the second direction is anywhere from −45° to 45° with respect to a second reference direction that is opposite the first reference direction.

22. The hearing aid system of claim 20, wherein the second direction is anywhere from −20° to 20° with respect to a second reference direction that is opposite the first reference direction.

23. The hearing aid system of claim 20, wherein the forward direction is with respect to a user of the hearing aid system.

24. A method for providing audio signals in a hearing aid system comprising a first hearing aid and a second hearing aid, the method comprising:

providing a first audio signal in accordance with a first primary spatial characteristic in a first operating mode of the hearing aid system;

providing a second audio signal in accordance with a second primary spatial characteristic in the first operating mode of the hearing aid system;

providing a first output signal based on the first audio signal;

providing a second output signal based on the second audio signal;

providing a first audio output based on the first output signal; and providing a second audio output based on the second output signal;

wherein the first primary spatial characteristic has a first main lobe with a first direction associated with a forward direction, and the second primary spatial characteristic has a second main lobe with a second direction associated with a backward direction;

wherein an angle between the first direction and the second direction is anywhere from 160° to 200°;

wherein the first primary spatial characteristic is attributable to a beamformer, and wherein the method further comprises providing a mode controller to control the beamformer; and wherein the mode controller is configured to communicate with the beamformer, and an additional beamformer.

25. The method of claim 24, wherein the second direction is substantially opposite from the first direction.

26. A method for providing audio signals in a hearing aid system comprising a first hearing aid and a second hearing aid, the method comprising:

providing a first audio signal in accordance with a first primary spatial characteristic in a first operating mode of the hearing aid system;

providing a second audio signal in accordance with a second primary spatial characteristic in the first operating mode of the hearing aid system;

providing a first output signal based on the first audio signal;

providing a second output signal based on the second audio signal;

providing a first audio output based on the first output signal; and providing a second audio output based on the second output signal;

wherein the first primary spatial characteristic has a first main lobe with a first direction, and the second primary spatial characteristic has a second main lobe with a second direction;

wherein the first direction is anywhere from −45° to 45° with respect to a first reference direction, and wherein the second direction is anywhere from −60° to 60° with respect to a second reference direction that is opposite the first reference direction, and wherein the first reference direction is a forward direction;

wherein the first primary spatial characteristic is attributable to a beamformer, and wherein the method further comprises providing a mode controller to control the beamformer; and wherein the mode controller is configured to control both the beamformer and an additional beamformer.

27. The method of claim 26, wherein the second direction is anywhere from −45° to 45° with respect to a second reference direction that is opposite the first reference direction.

28. The method of claim 26, wherein the second direction is anywhere from −20° to 20° with respect to a second reference direction that is opposite the first reference direction.

* * * * *